United States Patent [19]

Giblin et al.

[11] Patent Number: 4,723,860

[45] Date of Patent: Feb. 9, 1988

[54] SPRING-LOADED OVAL ROLLER DISPENSING PACKAGE

[75] Inventors: Edward J. Giblin; Susan B. Giblin, both of Pompton Lakes, N.J.

[73] Assignee: Lever Brothers Company, New York, N.Y.

[21] Appl. No.: 886,593

[22] Filed: Jul. 16, 1986

Related U.S. Application Data

[63] Continuation-in-part of Ser. No. 723,118, Apr. 15, 1985, abandoned.

[51] Int. Cl.[4] ..... A45D 34/04; B05C 17/02

[52] U.S. Cl. ..... 401/208; 401/206; 401/214; 401/219; 401/220

[58] Field of Search ..... 401/206, 208, 214, 220, 401/219

[56] References Cited

U.S. PATENT DOCUMENTS

| | | | |
|---|---|---|---|
| 554,189 | 2/1896 | Kochendarfer | 401/214 |
| 3,039,732 | 6/1962 | Hambley | 401/220 |
| 3,069,718 | 12/1962 | Brady et al. . | |
| 3,075,230 | 1/1963 | Marchant . | |
| 3,095,598 | 7/1963 | Gonnella et al. . | |
| 3,134,131 | 5/1964 | Thomas . | |
| 3,203,026 | 8/1965 | Schwartzman | 401/206 |
| 3,235,900 | 2/1966 | Klassen . | |
| 3,263,265 | 8/1966 | Judson | 401/208 X |
| 3,379,490 | 4/1968 | Schwartzman | 401/214 |
| 4,143,668 | 3/1979 | Duval et al. | 401/220 X |
| 4,150,904 | 4/1979 | Stewart | 401/219 X |
| 4,168,128 | 9/1979 | Fillmore et al. . | |
| 4,281,779 | 8/1981 | Shepard | 401/214 X |

FOREIGN PATENT DOCUMENTS

| | | | |
|---|---|---|---|
| 208946 | 6/1908 | Fed. Rep. of Germany | 401/219 |
| 962771 | 12/1949 | France | 401/208 |
| 496670 | 12/1938 | United Kingdom | 401/220 |

*Primary Examiner*—Steven A. Bratlie

*Attorney, Agent, or Firm*—Milton L. Honig; James J. Farrell

[57] ABSTRACT

A dispensing package is provided for delivery of liquids such as antiperspirants. The package has a fitment mounted upon a container holding liquid product. Within the fitment is a socket cradling an oval roller. At either ends of the socket are a pair of arms which communicate with the ends of the oval through a movement means permitting the oval to travel vertically within the socket. A spring with one or more upward protruding spuds is thrust from below through a floor base aperture and presses against the oval roller. Normally the spring pushes the spud through the aperture to seal the container. When the roller is pressed against a treating surface, e.g. skin, the roller pushes downward upon the spud thereby opening the floor base aperture permitting product to exit the container and be spread by the roller onto treatment surfaces.

31 Claims, 6 Drawing Figures

SPRING-LOADED OVAL ROLLER DISPENSING PACKAGE

This application is a C.I.P. of Ser. No. 06/723118 filed 4/15/85, now abandoned.

BACKGROUND OF THE INVENTION

This invention relates to an oval roller applicator package for dispensing liquid formulations. A wide variety of liquid products may utilize this applicator package. These products are not limited to but may include adhesives, paints, stain removers, topical medicines and cosmetics. The latter category includes colognes, aftershave lotions, body lotions, sun screens, suntan formulas and deodorants/antiperspirants. The applicator is particularly intended for the delivery of liquid deodorant/antiperspirants to underarm areas.

The spring loaded applicator is well known in the art for dispensing personal care products. For instance, U.S. Pat. No. 2,975,466 (Fillmore) discloses a roll-on applicator comprising a ball holder and an annular ball seat which is resiliently deformable. U.S. Pat. No. 2,968,826 (Leshin) reports a roll-on ball type dispenser wherein an annular ball support means is integral with the ball confining housing. The lower portion of this housing urges the ball against the annular sealing lip; the latter maintains the container in sealed condition until the ball is urged away from the lip. In one embodiment, a spring element is used which comprises a spider assembly including a central ball supporting button. U.S. Pat. No. 3,111,703 (Kaufman) discloses a roll-on applicator system wherein the supporting element for the ball includes a valve. In one embodiment, a slit is provided in the supporting element. When downward pressure is applied to the ball, the slit is opened by deformation allowing egress of fluid to the surface of the ball. When no pressure is applied to the ball, the slit is sealed, maintaining the container in sealed condition, upstream of the ball. A series of patents by Schwartzman which include U.S. Pat. Nos. 3,203,026, 3,340,561 and 3,379,490 all center on applicators utilizing a spring activated spud device for controlling the flow of a liquid product from its container.

These patents disclose devices which solve some but not all of the problems associated with roll-on applicators. Moreover, these devices require round balls which have certain disadvantages. One disadvantage is that round balls are limited to coating a relatively narrow area per stroke. Oval shaped rollers apply a much wider stripe per stroke. However, oval rollers are notorious for leaking; the oblate spheroid configuration hinders sealing which permits volatile components to escape past the roller by evaporation. Any oval roller type dispenser must therefore have a tight storage seal.

Heavier viscosity liquid formulations present additional delivery difficulties. They are prone to dry-out, leaving residues that can clog existing fitments. The roller, as a result, will not roll nor the product be dispensed. Self-cleaning mechanisms are desirable which would automatically unclog residue bearing fitments.

It is therefore an object of this invention to overcome the disadvantages associated with roll-on dispensing packages.

A more specific object is to provide an applicator employing an oval roller that will minimize evaporation of volatile components from the dispensing package.

Another object of this invention is to provide an applicator arrangement permitting maximum exposure of the oval roller surface area.

A further object of this invention is to provide a roll-on applicator which can regulate product flow while at the same time be self-cleaning.

Other objects, features and advantages of this invention will become apparent upon reference to the following detailed description of the invention and the drawings illustrating a preferred embodiment thereof.

SUMMARY OF THE INVENTION

An improved, roll-on dispensing package is provided having a container whereupon is mounted a fitment that holds an oval roller beneath which is a flow-control spring means. The fitment, at its uppermost end, forms a horizontally elongated socket with a cut out portion on an upper end and a floor base opposite said cut out portion. One or more apertures are situated in the floor base to allow selective communication of a liquid product, held in the container, with the socket. A pair of arms, one arm opposite the other, project upwards from the socket and partially define the cut out portion. The oval roller, having a short and long axis, is cradled between the pair of socket arms. Ends defining terminii of the long axis are each oriented adjacent to one of the socket arms. A movement means, permitting the roller only vertical and horizontal-axis rotational movements, connects the oval ends to the arms. A preferred movement means comprises a trunnion slidably moveable in a groove elongated vertically in a direction along the short axis.

A spring with one or more upward protruding spuds is horizontally situated below the oval roller, the spring through said spud(s) urging the roller to its upper, outwardmost position. A bottom seal, to prevent escape of liquid product through the floor base opening(s), is formed between the floor base opening(s) and the spud(s) as the latter moves upwards to fully mate into the opening(s).

The floor base opening-spud combination also serves as a valve means regulating flow of liquid product from the container to the roller. When the roller is depressed during usage, the spud reciprocates away from the floor base opening. With the aid of gravity, liquid product may flow through the opening and onto the roller. As the roller moves across the intended surface, the exposed portion of the roller surface continuously applies liquid product.

The floor base and spring may be either integrally molded with the fitment or be separate inserts held between brackets in the lower neck of the fitment. Spring tension is provided by a plurality of spoke members emanating from the spud. These spoke members may be helical or non-helical.

A number of further features are disclosed which enhance the effectiveness of the dispensing package. For instance, it is desirable that at least 30%, preferably at least 50% or more, but optimally between 60 to 70%, of the roller surface area protrude outwardly from the cut out socket portion. Secondly, the oval roller is desirably of hollow construction which permits use of a less powerful spring means. The hollow roller also ensures that the floor base aperture/spud valve will not open and product leak out during the "shake well" to emulsify emulsion products. Between the roller and socket/-floor base it is also desirable to leave a gap to prevent buildup of product; buildup would arise through the well known doctor blade phenomena. Preferably, there should also be a gap to prevent doctor-blading between the roller and the contoured perimeter defining the top edge of the socket. A spreading element may be interjected in the space between the roller and spring means. Foam or brush material may be used as the spreading element which serves as a temporary product reservoir and roller wiping device. Foam pads, when employed for this purpose, desirably should be of reticulated or open pore construction. A channel traversing at least part of the floor base and intersecting at least one of the floor base openings may be fashioned within the fitment. To permit total evacuation of product from the container, the wall surrounding the spring means may be interrupted by one or more relief openings. Finally, the surface of the roller may be textured or have a patterned surface with multiple ridges or indentations.

DETAILED DESCRIPTION OF A PREFERRED EMBODIMENT

Figure 1:
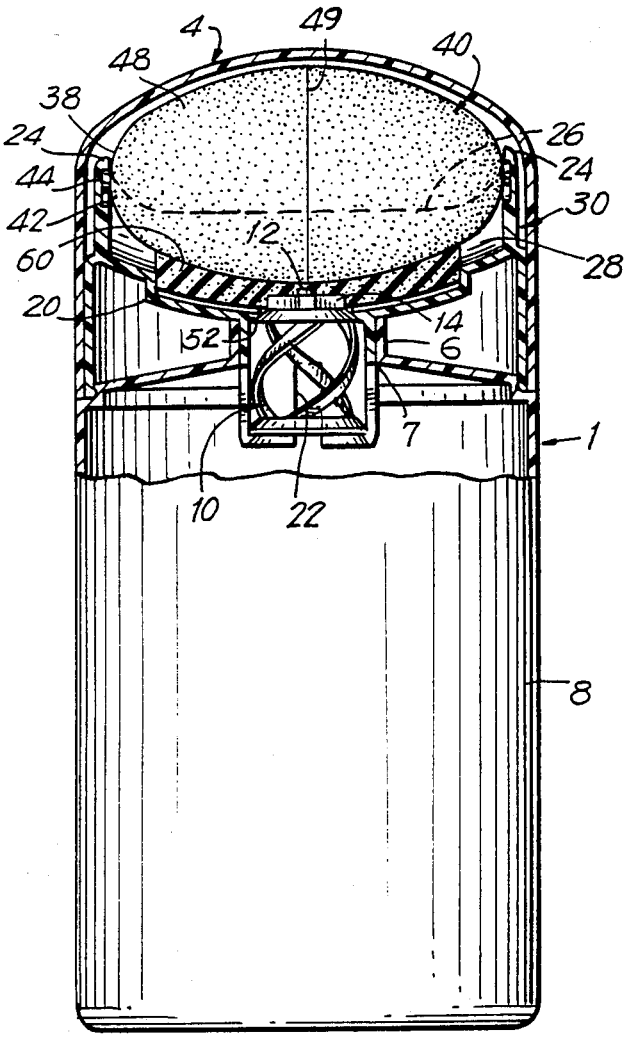
FIG. 1 is a partial cross-sectional, partial fragmentational perspective view of a preferred dispensing package of the instant invention.

In FIG. 1 the partially cut away dispenser package 1 comprises a container 8 having at the upper end a dispensing fitment 30. The overcap 4 fits over dispensing fitment 30 and attaches to the container by a snap-on mechanism wherein a perimeter on the inside bottom of the overcap forms an interference-fit seal with a lower part of the fitment. This seal reduces drying-out of product found in a spreading element 60, subsequently to be described. Fitment 30 contains a floor base 20 and spring means 10. The fitment 30 is slidably inserted into neck 6 of container 8. Preferably, the fitment 30 is held in place by a friction fit 7. In other embodiments, fitments that snap-fit over or within a top retaining lip on glass or plastic containers are particularly preferred.

Fitment 30 comprises an elongated socket 28 with a cut out portion, partially defined by ridge 26 at one end, and a floor base 20 facing said cut out portion. A pair of arms 24, one arm opposite the other, project upward forming part of the socket, partially define the cut out portion and connect with ridge 26.

Figure 2:
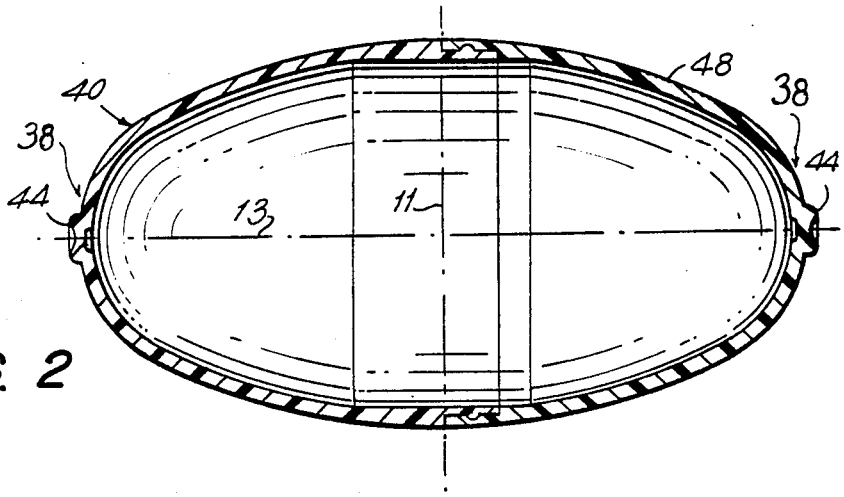
FIG. 2 is a cross-sectional view of a hollow two-part oval roller.

Within socket structure 28 of fitment 30 is contained an oval roller 40. The roller 40 has a short and a long axis, 11 and 13, respectively, and ends 38 defined by each terminus of the long axis. The ratio of long to short axis length can range from 3:1 to 1.5:1, but preferably is about 2:1. Ends 38 of the oval roller may be rounded, as shown in FIG. 2, or squared off. While roller 40 may be solid, it is preferable to utilize a hollow roller which permits weight reduction of this element. A lighter roller can operate with a less powerful, lighter spring resulting in cost efficiencies and improved performance. The roller may be formed by combining two hollow half oval cups. Cut 49 defines the connection profile between the half oval cups. Textured patterns 48 may also be embossed upon the roller surface. These patterns are both aesthetically pleasing and serve to enhance delivery of product.

Oval roller 40 is rotatably mounted within the socket structure 28. At least 30% of the surface area of roller 40 must protrude outwardly from the cut out portion of the socket. Preferably, the protrusion amounts to 50% or more, optimally between 60 to 70%. The oval rollers of this invention, by contrast to round ball roll-on devices, have the advantage of larger contact areas with substrates and need not be deeply seated to secure retention within the socket. Delivery of product becomes more efficient as surface area increases. Thus, the performance of the presently described oval rollers in delivering product is much superior to that of round balls.

Socket 28 features a low-profile ridge 26 which allows a further increase in product application surface area. When used to deliver antiperspirants to the skin, the low-profile ridge reduces skin and hair pinching normally associated with ball-type roll-on devices.

Figure 3:
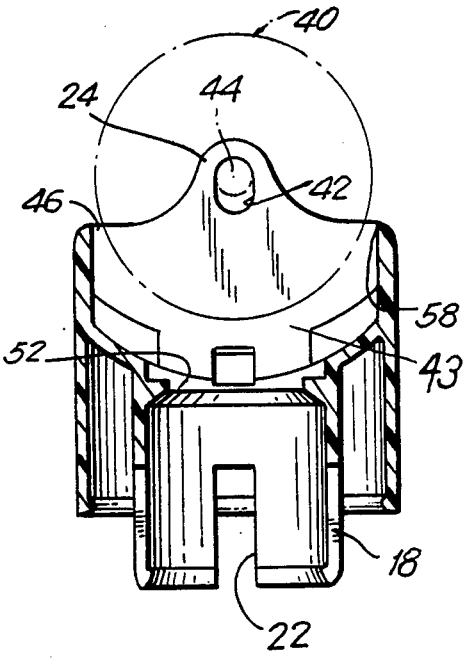
FIG. 3 is a partial cross-sectional, partial fragmentational side view of the fitment shown in FIG. 1.

A movement means permitting only vertical and horizontal-axis rotational movement of the oval roller connects each of the arms 24 to a roller end 38. A preferred embodiment of the movement means comprises a trunnion or peg 44 slidably moveable in an elongated groove 42 positioned vertically with respect to the container and in a direction along the short axis of the roller. FIG. 3 illustrates an instance where trunnion is attached to roller and the groove is formed within the arm. Alternatively, the trunnion may be fixedly attached to the arm while the groove may be formed at the ends of the roller.

Spring means 10 contacts the roller 40 through the leading surface 12 of the spud 14 and urges the roller 40 upward until arrested by the movement means, e.g. trunnion 44, abutting the top end of groove 42. The spring means 10 is preferably formed from a plastic which provides resilience for the spring action.

A circular wall 18 may surround spring means 10 lending protection and support thereto. Liquid product will then only be able to exit through floor base 20 by entering the opening directly below the spring means. This arrangement may cause difficulty in allowing the full product content to evacuate container 8. Therefore, it is desirable that within wall 18 there by one or more relief openings 22. FIG. 3 provides a view of one of these openings. An additional three openings (not shown) interrupt wall 18. In the preferred embodiment, each of the four openings are spaced 90° apart from one another within the circular wall. As a result of these openings, product will be enabled to fully drain from the inverted container.

Located between spring means 10 and roller 40 is a floor base 20. An aperture 52 is positioned within floor base 20 thereby permitting fluid communication between the container 8 and the interior of fitment 30 through which spud 14 of the spring means 10 protrudes and slidably mates to form a seal. While a single apertured floor base/spud combination is preferred, this invention is not limited thereto. Floor base 20 may be fashioned with a plurality of aperture holes 52, providing, however, that an identical number of spud members 14 each sealably mate with apertures 52 when spring means 10 is in the resting position.

Between the roller and socket/floor base, it is desirable to leave a gap 43 to prevent buildup of product.

There would be a tendency, in the absence of the gap, for product buildup caused by the doctor blade phenomena. For similar reasons, desirably there should be a gap 46 between oval roller 40 and the contoured perimeter 58 defining the top edge of the socket.

Roller and spud may directly contact one another. A preferred embodiment, however, employs a spreading element 60 sited in a space between roller and spud. Within the spreading element there must be areas for retaining fluid product. Foams or brushes serve well as such elements. They perform both a spreading and wiping function. When the spreading element is a foam, it is preferably compressed to help urge the roller upwards to its sealing position.

Figure 4:
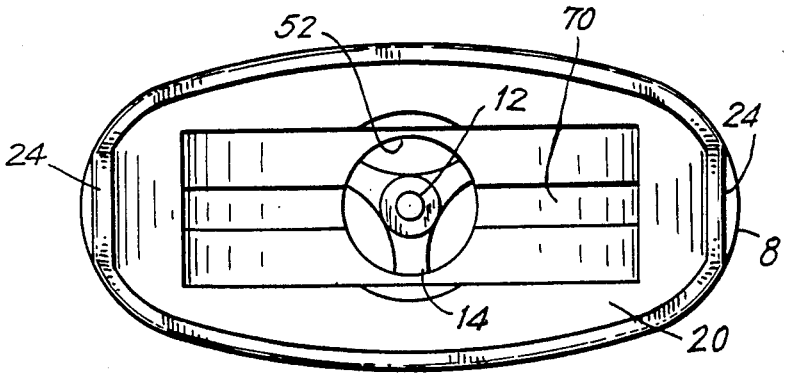
FIG. 4 is a top view of the floor base and socket (roller removed) shown in FIG. 1.

Another feature that may be included within the dispensing package is a channel 70, best illustrated in FIG. 4. Channel 70 traverses at least part of floor base 20 and intersects at least one of the apertures 52. Particularly desirable is when channel 70 traverses the floor base in a direction parallel to the long axis of the oval roller. It is the purpose of channel 70 to serve as a trough directing product, expressed from the container, onto the roller. Channel 70 also hinders seepage of product near the socket arms.

Figure 5:
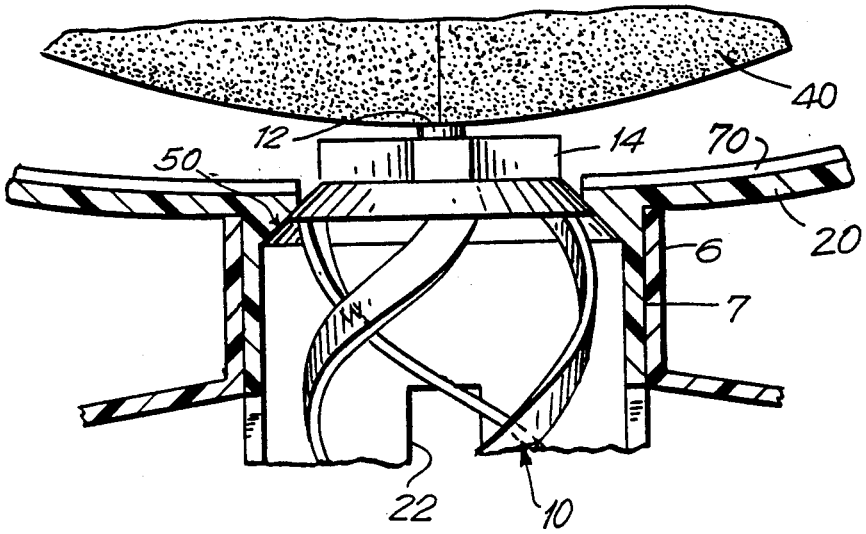
FIG. 5 is a fragmentary sectional expanded view of the seal in FIG. 1 stationed in the normally closed position.

FIG. 5 illustrates seal 50 where the floor base/spud arrangement is in the closed position. Spud 14 slidably mates with the edges of the aperture of floor base 20 thus completely obstructing the flow of any fluid from the container 8 to the interior of the fitment 30, the roller 40 or the outer atmosphere. This is the normally sealed position of fitment 30.

Figure 6:
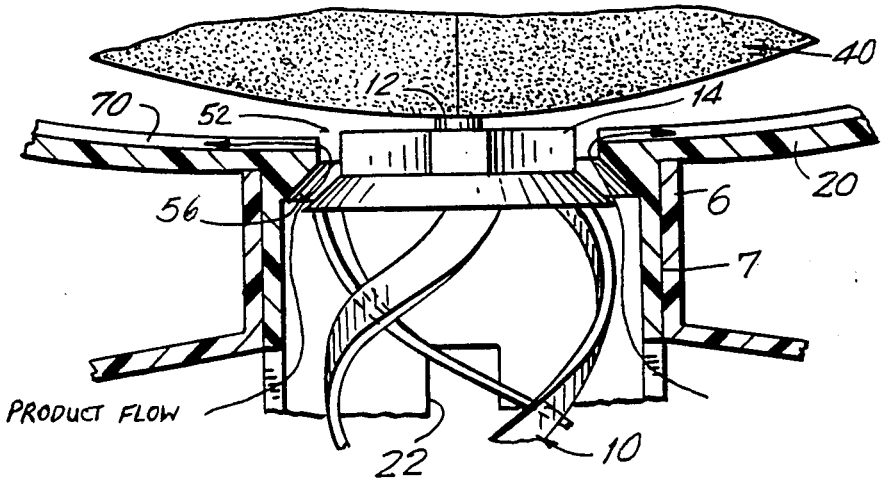
FIG. 6 is a view similar to FIG. 5 except the seal is in the almost completely open position.

When material is intended to be expressed from the container 8, roller 40 is pressed against a surface requiring treatment, e.g. against the human underarm for application of antiperspirant. This action depresses the roller. The movement means allows the roller to travel downward along the path described by groove 42 best illustrated in FIG. 3. FIG. 6 illustrates the configuration when a surface to be treated presses against roller 40 which in turn depresses spring means 10 by contact with spud 14. An annular channel 56 thereupon opens between spud 14 and the aperture in the floor base 20 permitting flow of liquid from the container 8 to the surface of roller 40. The roller may then rotate about its long axis under the influence of container 8 being applied along the surface to be treated. This, in turn, spreads liquid onto the treated surface. By varying the outside pressure on roller 40, opening 52 may be varied. Greater depression of the roller 40 results in a larger seal opening at 52.

Accordingly, it is to be understood that the invention in its broader aspect is not limited to the specific elements shown and described, but also includes within the scope of the accompanying claims any departures made from such elements which do not sacrifice its chief advantages.

What is claimed is:

1. A dispensing package comprising:

a container;

a fitment mounted on and adapted to selectively communicate with the interior of said container, said fitment having an elongated socket with a cut out portion on an upper end thereof and a floor base forming a bottom to said socket stationed above said container, said floor base having one or more apertures to allow selective communication between said socket and said container;

a pair of arms, one arm opposite the other, projecting upwards forming part of said socket and partially defining said cut out portion;

an oval roller substantially hollow and formed in two sections, said roller having a short and long axis and an end defined by each terminus of said long axis, said ends adjacent to said arms, and said oval roller rotatably mounted within said socket;

a movement means permitting vertical and horizontal-axis rotational movement of said oval roller, said means connecting said arms and said ends;

spring means mounted contiguous to the flooor base, said spring means having one or more spuds with leading edges mounted thereon and being in cooperative movable relationship with said spring means, said spuds under the influence of said spring means normally extending through the apertures in said floor base in fluid sealing relationship therewith;

a finger vertically protruding from an upper surface of said one or more spuds;

a channel traversing at least part of said floor base and intersecting at least one of said apertures;

an elongate spreading element having areas for retaining fluid product for wiping and spreading said product, said element positioned in a space between said roller and said spring means and in contact with said channel;

whereby upon exerting a force upon said oval roller, overcoming the tension of said spring means, said roller moves downward and said spud moves out of sealing relationship with the aperture in said floor base, allowing communication between the interior of said socket and said container and the surface of said roller.

2. A dispensing package according to claim 1 wherein at least 30% of the surface area of said roller protrudes outwardly from said cut out portion.

3. A dispensing package according to claim 1 wherein at least 50% of the surface area of said roller protrudes outwardly from said cut out portion.

4. A dispensing package according to claim 1 wherein said movement means comprises a trunnion slidably moveable in a groove, said groove vertically elongated in a direction parallel to said short axis.

5. A dispensing package according to claim 4 wherein said trunnion is attachedly held to said end of said roller and said groove is formed in said arm.

6. A dispensing package according to claim 4 wherein said trunnion is attachedly held in said arm and said groove is formed on said end of said roller.

7. A dispensing package according to claim 1 wherein said spreading element is compressed.

8. A dispensing package according to claim 1 wherein said spreading element is a foam material.

9. A dispensing package according to claim 1 wherein said spreading element is a brush.

10. A dispensing package according to claim 1 wherein the ratio of the lengths of said long to short axis is from about 3:1 to about 1.5:1.

11. A dispensing package according to claim 1 wherein the ratio of the lengths of said long to short axis is about 2:1.

12. A dispensing package according to claim 1 wherein said ends of said oval roller are squared-off.

13. A dispensing package according to claim 1 wherein said oval roller has a patterned surface.

14. A dispensing package according to claim 13 wherein said surface is patterned with multiple ridges or indentations.

15. A dispensing package according to claim 13 wherein said surface is textured.

16. A dispensing package according to claim 1 wherein said channel traverses said floor base in a direction parallel to said long axis of said roller.

17. A dispensing package according to claim 1 wherein said spring means is of a resilient construction.

18. A dispensing package according to claim 1 wherein said spring means is integrally molded with said fitment.

19. A dispensing package according to claim 1 wherein said spring means is held between brackets in said fitment.

20. A dispensing package according to claim 1 wherein said floor base is integrally molded with said fitment.

21. A dispensing package according to claim 1 wherein said floor base is held between brackets in said fitment.

22. A dispensing package according to claim 1 wherein said spring means has helically arranged spoke members.

23. A dispensing package according to claim 1 wherein said spring means has non-helically arranged spoke members.

24. A dispensing package according to claim 1 wherein said spring means and said floor base are fitted with a single spud and single aperture, respectively.

25. A dispensing package according to claim 1 wherein the upper surface of said one or more spuds is substantially flat.

26. A dispensing package according to claim 1 wherein the upper surface of said one or more spuds is rounded.

27. A dispensing package according to claim 1 wherein the upper surface of said one or more spuds defines at least two raised spokes emanating from a central hub.

28. A dispensing package according to claim 27 wherein said spokes form a cross.

29. A dispensing package according to claim 27 wherein there are three spokes, each equidistant from the other.

30. A dispensing package according to claim 1 further comprising an encasement wall cylindrically surrounding said spring means positioned below said floor base, said encasement projecting downwards from said floor base into said container.

31. A dispensing package according to claim 30 wherein said encasement wall has one or more openings therein which communicate with said container.

* * * * *